US010643765B2

(12) United States Patent
Nakamura

(10) Patent No.: US 10,643,765 B2
(45) Date of Patent: May 5, 2020

(54) CABLE HARNESS

(71) Applicant: JAPAN AVIATION ELECTRONICS INDUSTRY, LIMITED, Shibuya-ku, Tokyo (JP)

(72) Inventor: Keisuke Nakamura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/448,506

(22) Filed: Jun. 21, 2019

(65) Prior Publication Data

US 2020/0005962 A1 Jan. 2, 2020

(30) Foreign Application Priority Data

Jul. 2, 2018 (JP) ..... 2018-125718

(51) Int. Cl.
*H01R 24/38* (2011.01)
*H01B 7/00* (2006.01)
*H01B 11/18* (2006.01)

(52) U.S. Cl.
CPC ..... *H01B 7/0045* (2013.01); *H01B 11/1834* (2013.01); *H01R 24/38* (2013.01)

(58) Field of Classification Search
CPC ..... H01R 13/6593; H01R 24/38
USPC ..... 439/607.47
See application file for complete search history.

(56) References Cited

U.S. PATENT DOCUMENTS 4,653,836 A * 3/1987 Peele ..... H01R 13/6593 439/607.47
5,108,313 A * 4/1992 Adams ..... H01R 13/514 439/607.47
5,199,903 A * 4/1993 Asick ..... H01R 9/032 439/607.47
5,848,914 A * 12/1998 Lang ..... H01R 13/6592 439/607.47
7,156,678 B2 * 1/2007 Feldman ..... H01R 4/024 439/326

(Continued)

FOREIGN PATENT DOCUMENTS

JP 2005190798 A 7/2005
JP 2006079936 A 3/2006
JP 2013084498 A 5/2013

OTHER PUBLICATIONS

Extended European Search Report (EESR) dated Nov. 27, 2019 issued in European Application No. 19182494.5.

*Primary Examiner* — Neil Abrams
(74) *Attorney, Agent, or Firm* — Holtz, Holtz & Volek PC

(57) ABSTRACT

A cable harness comprises a coaxial cable and a connector. The coaxial cable comprises an outer conductor formed of a plurality of wires and a second insulator covering the outer conductor. The outer conductor has a partially-exposed portion. The partially-exposed portion is formed with a connection portion. The second insulator has a partial cover. In a perpendicular plane perpendicular to the front-rear direction, the partial cover covers the partially-exposed portion while at least the connection portion is exposed. The connector comprises a second conductor. The second conductor has a pressure-holding portion. The pressure-holding portion presses the partial cover to hold the partial cover and is connected to the connection portion in a perpendicular direction perpendicular to the front-rear direction.

10 Claims, 9 Drawing Sheets

(56) References Cited

U.S. PATENT DOCUMENTS

| | | | | |
|---|---|---|---|---|
| 8,172,613 | B1 * | 5/2012 | Chen | H01R 9/0518 439/582 |
| 8,523,602 | B2 * | 9/2013 | Figie | H01R 13/502 439/466 |
| 8,668,521 | B2 * | 3/2014 | Sasaki | H01R 24/38 439/582 |
| 8,747,153 | B2 | 6/2014 | Takano et al. | |
| 8,905,782 | B2 * | 12/2014 | Zhao | H01R 9/0524 439/582 |
| 8,939,794 | B2 * | 1/2015 | Mason | H01R 9/0515 439/581 |
| 9,184,535 | B2 * | 11/2015 | Tsuchida | H01R 13/62 |
| 9,306,325 | B2 * | 4/2016 | Cheng | H01R 13/6271 |
| 9,979,122 | B1 * | 5/2018 | Nakamura | H01R 12/75 |
| 2013/0149897 | A1 | 6/2013 | Takano et al. | |
| 2013/0319761 | A1 | 12/2013 | Furukawa | |
| 2016/0172789 | A1 * | 6/2016 | Li | H01R 13/6594 439/78 |
| 2017/0025769 | A1 | 1/2017 | Tokunaga et al. | |
| 2020/0005962 | A1 * | 1/2020 | Nakamura | H01B 7/0045 |

* cited by examiner

CABLE HARNESS

CROSS REFERENCE TO RELATED APPLICATIONS

This application is based on and claims priority under 35 U.S.C. § 119 to Japanese Patent Application No. JP2018-125718 filed Jul. 2, 2018, the content of which is incorporated herein in its entirety by reference.

BACKGROUND OF THE INVENTION

This invention relates to a cable harness comprising a coaxial cable and a connector.

For example, this type of cable harness is disclosed in JP2013-84498A (Patent Document 1), the content of which is incorporated herein by reference.

Referring to FIG. 15, Patent Document 1 discloses a cable harness 90 which comprises a coaxial cable 92 and a coaxial cable device (connector) 94. The coaxial cable 92 comprises a center conductor 922, an inner insulator 924 covering the center conductor 922, an outside conductor (outer conductor) 926 covering the inner insulator 924 and a surface insulator 928 covering the outer conductor 926. The connector 94 comprises a contact member having center conductive connection portions 942 and a ground contact member having a shell portion 944 and a cable support portion 946. The coaxial cable 92 is attached to the cable support portion 946 under a state where an end portion of the center conductor 922 is exposed, and an end portion of the outer conductor 926 is exposed. When the illustrated shell portion 944 is bent to be combined with the cable support portion 946, the center conductive connection portions 942 sandwich the center conductor 922 therebetween, and the shell portion 944 and the cable support portion 946 sandwich the outer conductor 926 therebetween.

In general, a braided shield is often used as an outer conductor of a coaxial cable. The braided shield is formed of a plurality of braided conductive threads which are hard to be separated from one another when sandwiched between two members as shown in Patent Document 1. Instead of this braided shield, a spiral shield is sometimes used as an outer conductor of a coaxial cable. The spiral shield is formed of a plurality of wires which are combined so as to extend spirally. The outer diameter of the coaxial cable with the spiral shield can be reduced in comparison with that of the coaxial cable with the braided shield, while the wires of the spiral shield are relatively easy to be separated from one another. In particular, when the spiral shield is exposed and sandwiched, the wires thereof might be unevenly separated from one another, so that transmission characteristics might be degraded.

SUMMARY OF THE INVENTION

It is therefore an object of the present invention to provide a cable harness having transmission characteristics hard to be degraded even if an outer conductor of a coaxial cable of the cable harness is formed of a spiral shield.

An aspect of the present invention provides a cable harness comprising a coaxial cable and a connector. The coaxial cable comprises a center conductor, a first insulator covering the center conductor, an outer conductor covering the first insulator and a second insulator covering the outer conductor. The outer conductor is formed of a plurality of wires and has a non-exposed portion and a partially-exposed portion. The partially-exposed portion is located forward of the non-exposed portion in a front-rear direction. The partially-exposed portion is formed with a connection portion. The second insulator has an annular cover and a partial cover. The partial cover is located forward of the annular cover. The annular cover entirely covers circumference of the non-exposed portion in a perpendicular plane perpendicular to the front-rear direction. In the perpendicular plane, the partial cover covers the partially-exposed portion while at least the connection portion is exposed. The connector comprises a first conductor, a second conductor and a holding member. The first conductor and the second conductor are insulated from each other. The holding member holds the first conductor. The first conductor is connected to the center conductor. The second conductor has a pressure-holding portion. The pressure-holding portion presses the partial cover to hold the partial cover and is connected to the connection portion in a perpendicular direction perpendicular to the front-rear direction.

The outer conductor of the coaxial cable according to an aspect of the present invention is formed of a plurality of the wires and has the partially-exposed portion that is formed with the connection portion connected to the connector. The partially-exposed portion is partially covered by the partial cover of the second insulator while the connection portion is exposed. The partial cover partially covers the wires of the outer conductor, so that the wires are prevented from being unevenly separated from one another. As a result, transmission characteristics are hard to be degraded. Thus, an aspect of the present invention provides the cable harness having transmission characteristics hard to be degraded even if the outer conductor of its coaxial cable is formed of a spiral shield.

An appreciation of the objectives of the present invention and a more complete understanding of its structure may be had by studying the following description of the preferred embodiment and by referring to the accompanying drawings.

Figure 1:
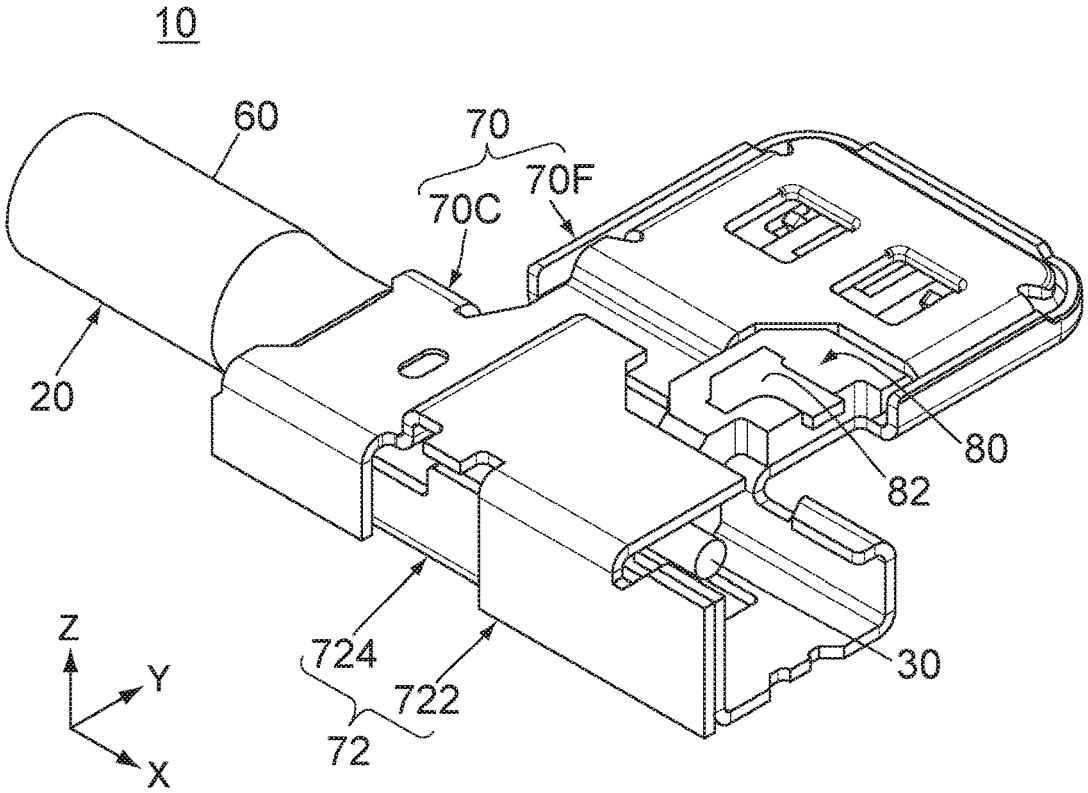
FIG. 1 is a perspective view showing a cable harness according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a cable harness 10 according to an embodiment of the present invention comprises a coaxial cable 20 and a connector 70. The cable harness 10 of the present embodiment is used to connect the coaxial cable 20 with a mating connector (not shown). However, the present invention is not limited thereto but is applicable to various cable harnesses.

Figure 2:
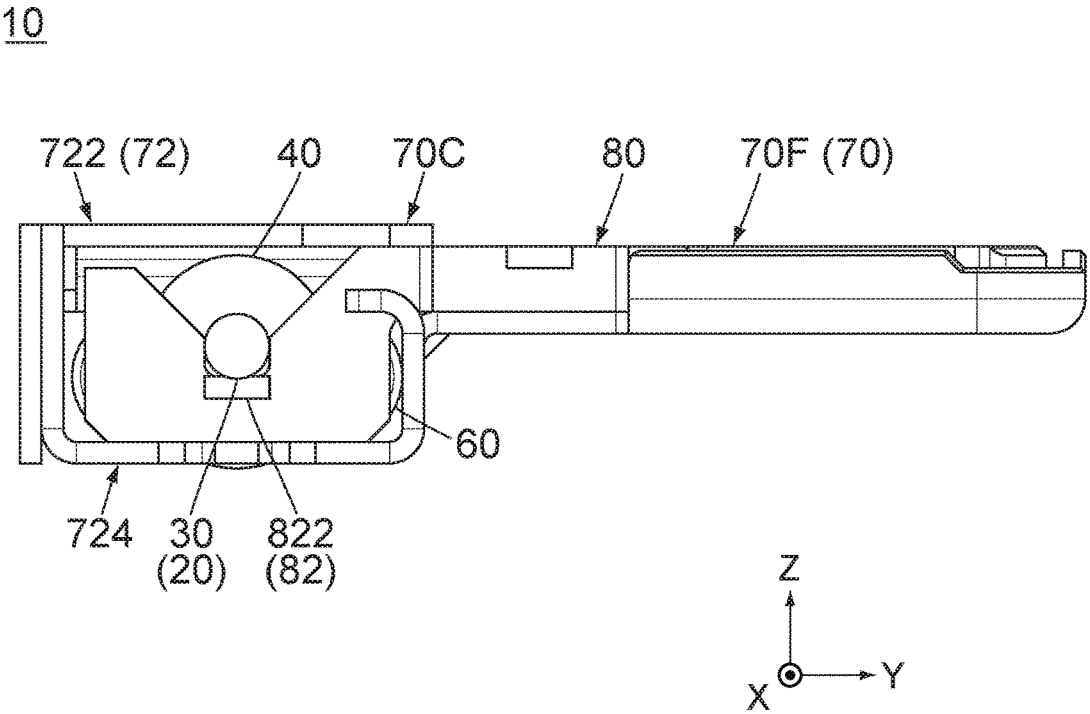
FIG. 2 is a front view showing the cable harness of FIG. 1.
Figure 3:
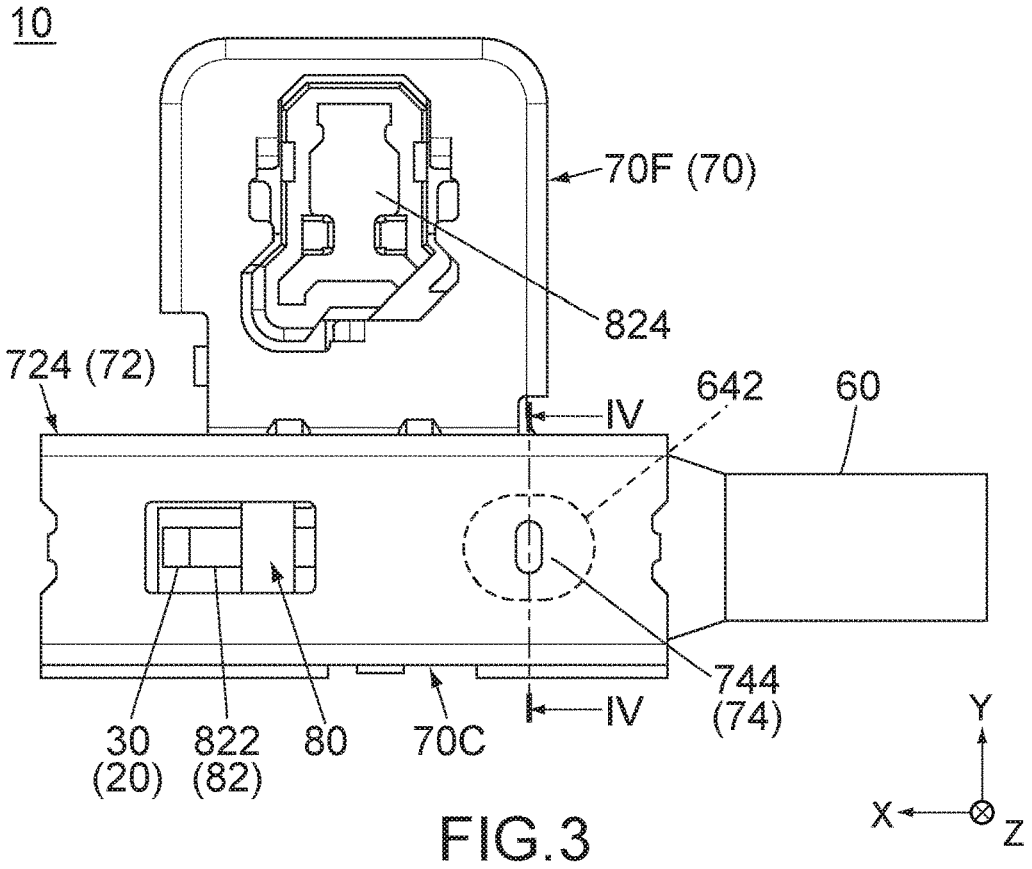
FIG. 3 is a bottom view showing the cable harness of FIG. 1, wherein an outline of a hidden long hole of a coaxial cable is illustrated in dashed line.

As shown in FIGS. 1 to 3, the connector 70 of the present embodiment has a cable connection portion 70C and a mating portion 70F. The cable connection portion 70C is a part to which the coaxial cable 20 is attached. The cable connection portion 70C extends along a front-rear direction (X-direction). The mating portion 70F is a part which is to be mated with the mating connector (not shown). The mating portion 70F projects from the cable connection portion 70C in a lateral direction (Y-direction) perpendicular to the X-direction. The connector 70 of the present embodiment has the aforementioned structure as illustrated in figures. However, the structure of the connector of the present invention is not limited thereto but can be variously modified.

The connector 70 comprises a signal contact (first conductor) 82 made of conductor, a ground member (second conductor) 72 and a holding member 80 made of resin. The first conductor 82 and the second conductor 72 are insulated from each other. When the cable harness 10 is used, the first conductor 82 works as a signal contact, and the second conductor 72 is grounded.

The holding member 80 holds the first conductor 82. According to the present embodiment, the first conductor 82 is embedded in the holding member 80 via insert-molding and held by the holding member 80. However, the present invention is not limited thereto. For example, the first conductor 82 may be press-fit into and held by the holding member 80.

Referring to FIGS. 2 and 3, the first conductor 82 has a contact portion 822 and a terminal portion 824. The contact portion 822 and the terminal portion 824 are exposed outward from the holding member 80. The contact portion 822 is located in the cable connection portion 70C, and the terminal portion 824 is located in the mating portion 70F.

Referring to FIGS. 1 to 3, the second conductor 72 of the present embodiment comprises an upper ground member 722 made of conductor and a lower ground member 724 made of conductor. Each of the upper ground member 722 and the lower ground member 724 is a single metal plate with bends. Moreover, the upper ground member 722 and the lower ground member 724 are members separable from each other. However, the present invention is not limited thereto. For example, the upper ground member 722 and the lower ground member 724 may be formed integrally with each other to be an integral member.

Referring to FIGS. 1 and 5 to 7, in the present embodiment, the upper ground member 722, the holding member 80 and the lower ground member 724 are arranged in an upper-lower direction (Z-direction) perpendicular to both the X-direction and the Y-direction. The upper ground member 722 and the lower ground member 724 of the second conductor 72 are vertically combined to each other while vertically sandwiching the holding member 80. The upper ground member 722 and the lower ground member 724 of the thus-combined second conductor 72 cover, at least in part, the first conductor 82 and the holding member 80 in the Z-direction. However, the present invention is not limited thereto. For example, the second conductor 72 may be a member other than the upper ground member 722 and the lower ground member 724. In this case, the holding member 80 may hold the second conductor 72 as well as the first conductor 82.

Figure 5:
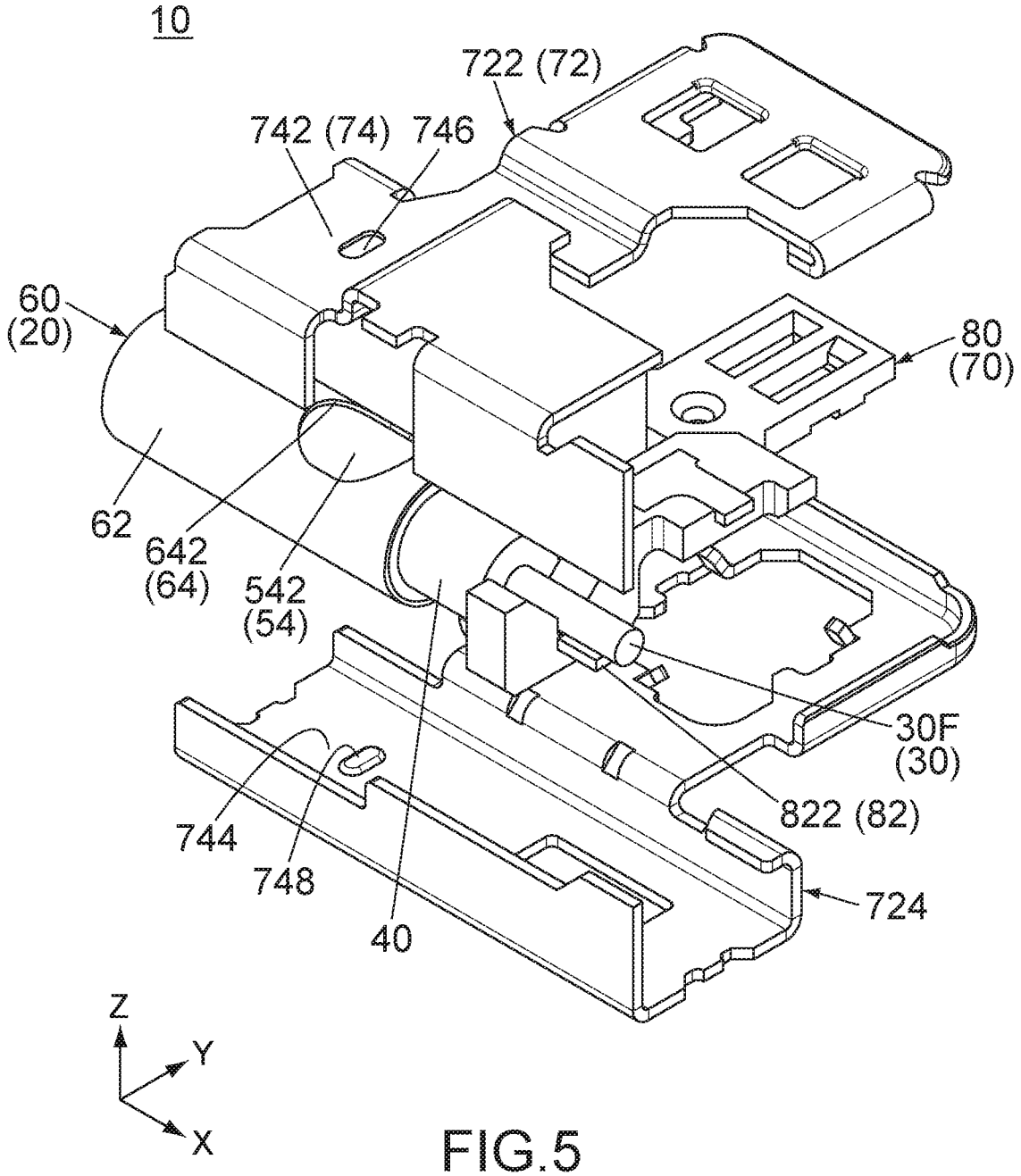
FIG. 5 is an exploded, perspective view showing the cable harness of FIG. 1.
Figure 6:
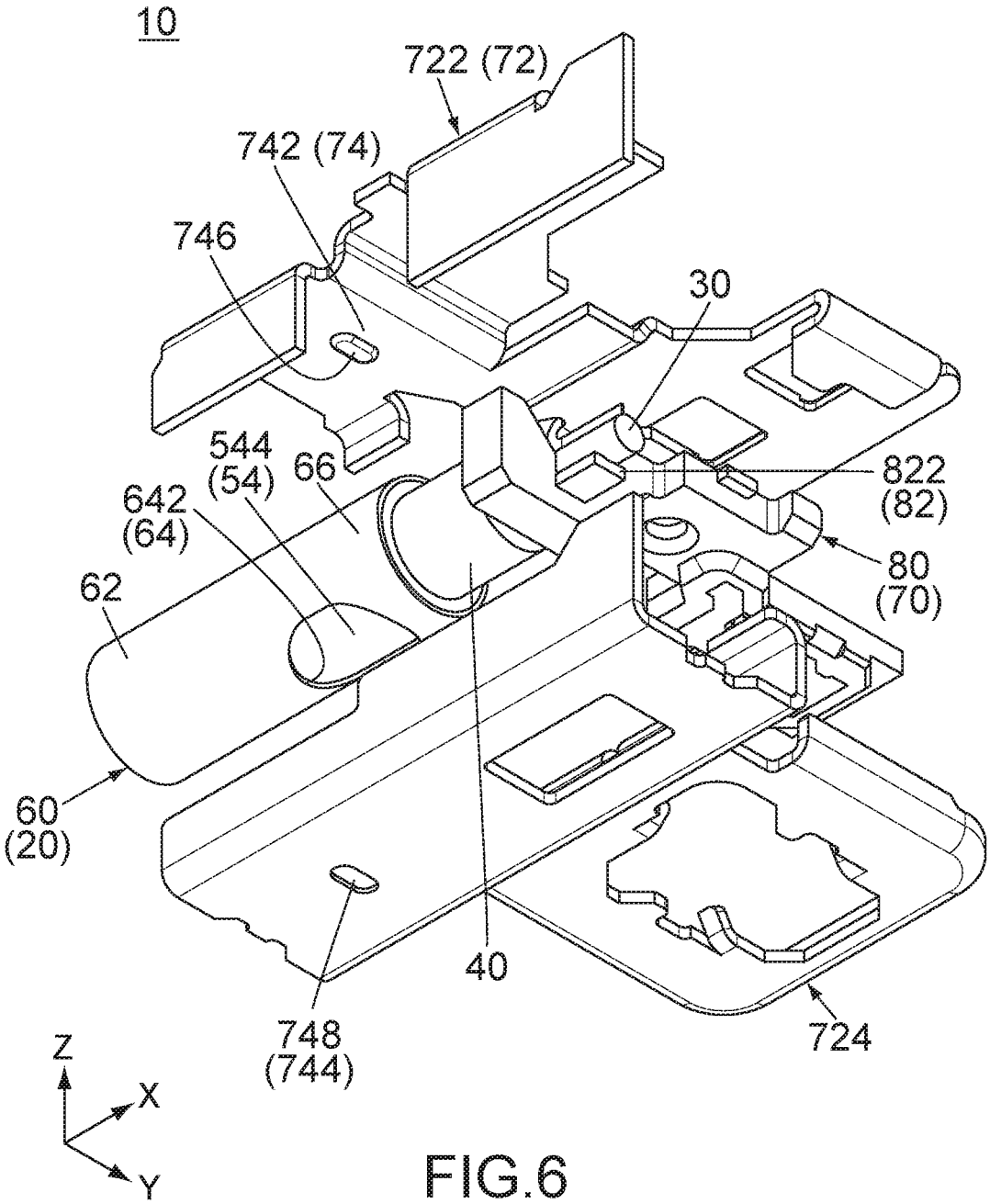
FIG. 6 is another exploded, perspective view showing the cable harness of FIG. 5.
Figure 7:
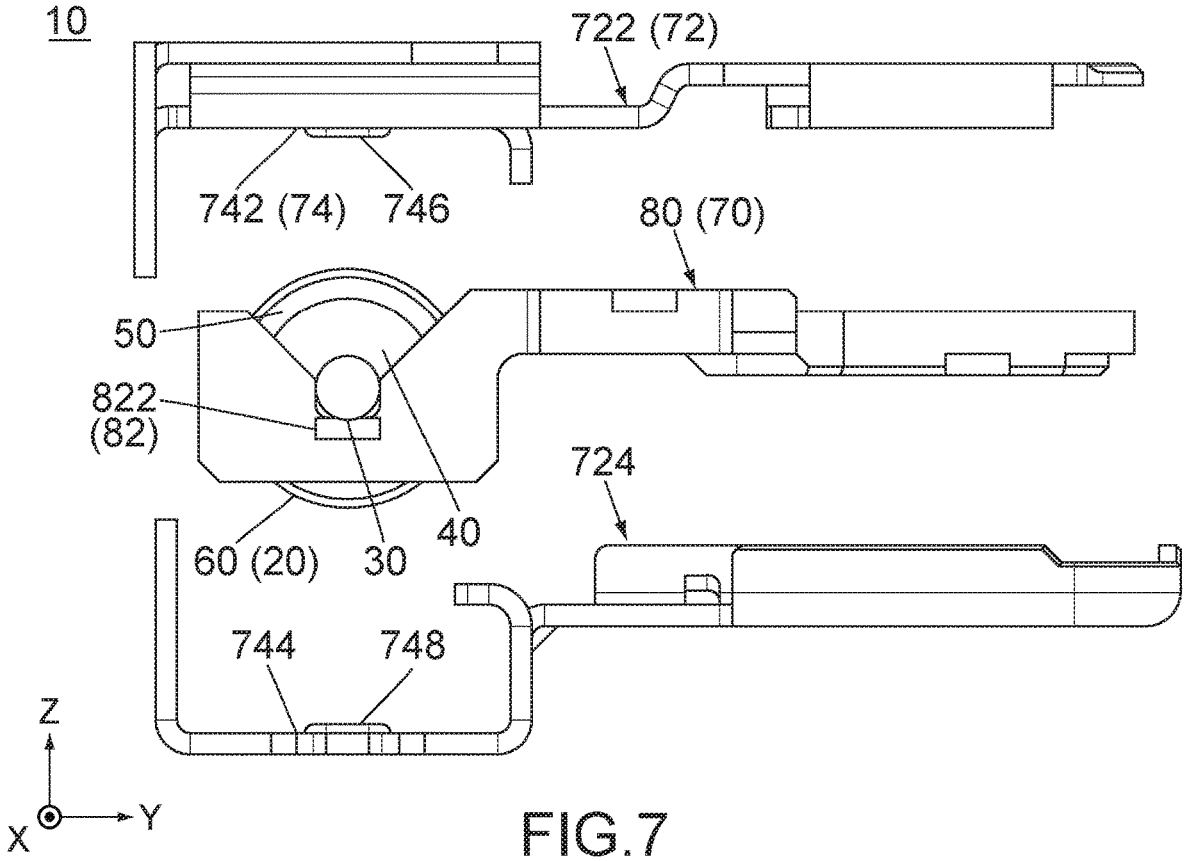
FIG. 7 is a front view showing the cable harness of FIG. 5.

Referring to FIGS. 5 to 7, the second conductor 72 has a pressure-holding portion 74. The pressure-holding portion 74 of the present embodiment includes an upper holding portion 742 and a lower holding portion 744. The upper holding portion 742 is a part of an upper plate, or the positive Z-side plate, of the upper ground member 722 and extends in parallel to a horizontal plane (XY-plane). The lower holding portion 744 is a part of a lower plate, or the negative Z-side plate, of the lower ground member 724 and extends in parallel to the XY-plane. The upper holding portion 742 and the lower holding portion 744 are located across the coaxial cable 20 from each other in the Z-direction.

The pressure-holding portion 74 of the present embodiment is provided with two projecting portions 746 and 748 each of which is long in the Y-direction. In detail, the upper holding portion 742 of the pressure-holding portion 74 partially projects downward, or in the negative Z-direction, so that the upper projecting portion 746 is formed. Similarly, the lower holding portion 744 of the pressure-holding portion 74 partially projects upward, or in the positive Z-direction, so that the lower projecting portion 748 is formed. Thus, the pressure-holding portion 74 is provided with the upper projecting portion 746 and the lower projecting portion 748.

According to the present embodiment, the two projecting portions 746 and 748, namely the upper projecting portion 746 and the lower projecting portion 748, have shapes same as each other. In particular, each of the upper projecting portion 746 and the lower projecting portion 748 has a first length in the X-direction and a second length in the Y-direction. In each of the upper projecting portion 746 and the lower projecting portion 748, the second length is longer than the first length. Moreover, the two projecting portions 746 and 748 are located at positions same as each other in the X-direction and located across the coaxial cable 20 from each other in the Z-direction. As described later, the aforementioned structure of the pressure-holding portion 74 including the projecting portions 746 and 748 can be variously modified.

Referring to FIGS. 8 to 11, the coaxial cable 20 comprises a center conductor 30 made of conductor, a first insulator 40 made of insulator, an outer conductor 50 made of conductor and a second insulator 60 made of insulator.

Figure 11:
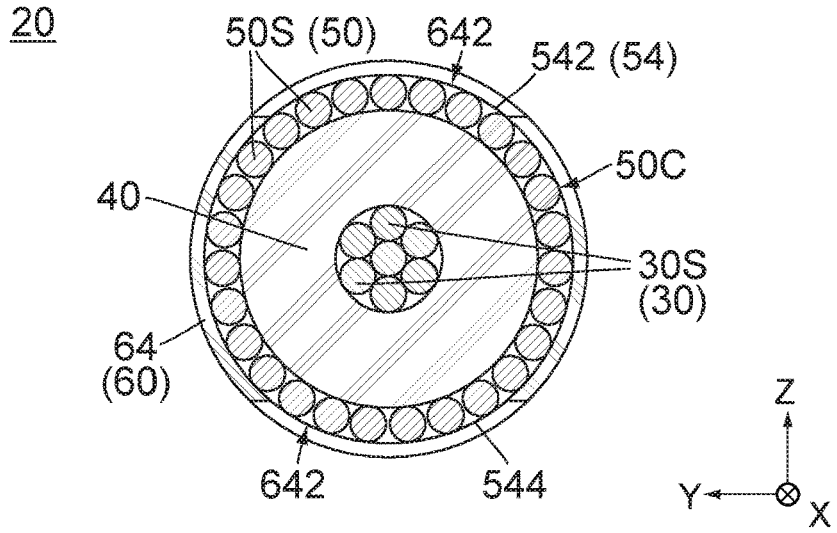
FIG. 11 is a cross-sectional view showing the coaxial cable of FIG. 10, taken along line XI-XI.

Referring to FIG. 1, the coaxial cable 20 is attached to the connector 70 so as to extend along the X-direction. Referring to FIG. 11 together with FIG. 4, the coaxial cable 20 of the present embodiment has a circular shape in a perpendicular plane (YZ-plane) perpendicular to the X-direction before the coaxial cable 20 is attached to the connector 70. However, the present invention is not limited thereto. For example, the coaxial cable 20 may have an elliptical shape in the YZ-plane before the coaxial cable 20 is attached to the connector 70.

According to the present embodiment, the first insulator 40 covers circumference of the center conductor 30 in the YZ-plane, and the outer conductor 50 covers circumference of the first insulator 40 in the YZ-plane. The outer conductor 50 has circumference 50C that is the farthest part from the center conductor 30 in the YZ-plane. The circumference 50C is located on a circle about the center conductor 30 in the YZ-plane. The second insulator 60 covers the circumference 50C of the outer conductor 50 in the YZ-plane.

Figure 8:
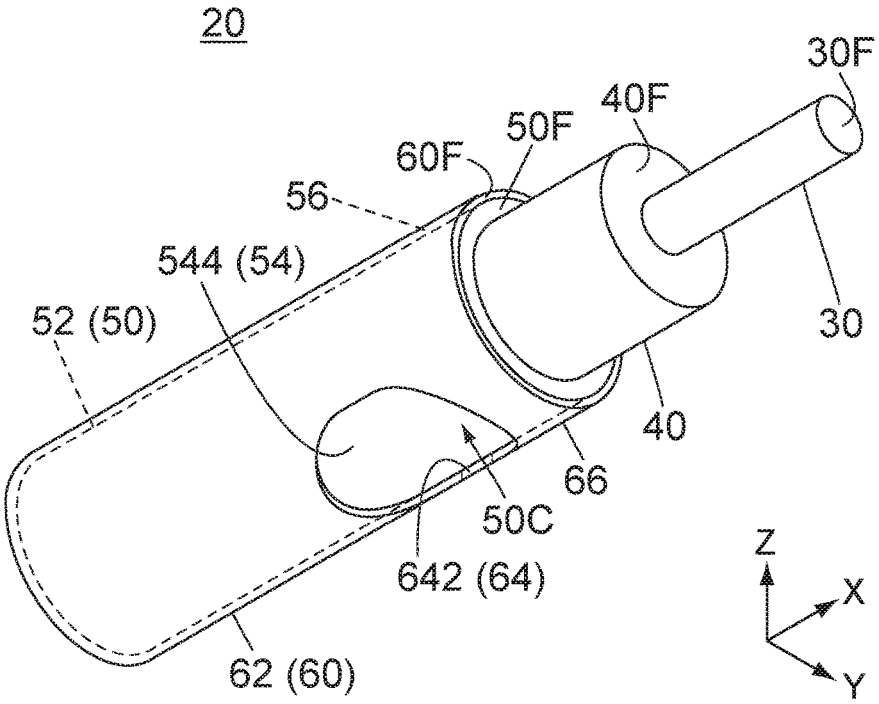
FIG. 8 is a perspective view showing the coaxial cable of the cable harness of FIG. 6, wherein a hidden outline of an outer conductor is illustrated in dashed line.

As can be seen from FIG. 8, a front end portion (positive X-side portion) of the outer conductor 50 and a front end portion of the second insulator 60 are stripped off, so that a front end portion of the first insulator 40 is exposed. Thereafter, a front end portion of the first insulator 40 is stripped off, so that a front end portion of the center conductor 30 is exposed. Referring to FIG. 1, the coaxial cable 20 is attached to the cable connection portion 70C of the connector 70 and extends in the cable connection portion 70C along the X-direction while the front end portion thereof is stripped off as described above.

Referring to FIG. 11, the center conductor 30 of the present embodiment is formed of a plurality of center wires 30S (conductive wires). The center wires 30S are combined to extend spirally, so that the one center conductor 30 is formed. However, the present invention is not limited thereto. For example, the center conductor 30 may be formed of one of the center wires 30S.

The outer conductor 50 is formed of a plurality of wires 50S (conductive wires). The wires 50S of the present embodiment are combined to extend spirally, so that the one outer conductor 50 is formed. In other words, the outer conductor 50 of the present embodiment is a spiral shield. However, the present invention is not limited thereto. For example, each of the wires 50S may extend linearly along the X-direction.

Referring to FIG. 8, the center conductor 30 extends to a front end 30F thereof along the X-direction. The first insulator 40 extends to a front end 40F thereof along the X-direction. The front end 40F is located at a rear position, or the negative X-side position, in comparison with the front end 30F of the center conductor 30. The outer conductor 50 extends to a front end 50F thereof along the X-direction, and the second insulator 60 extends to a front end 60F thereof along the X-direction. Each of the front end 50F and the front end 60F is located at a rear position in comparison with the front end 40F of the first insulator 40. According to the present embodiment, the front end 50F is located at a position same as that of the front end 60F in the X-direction. However, as described later, the positional relation between the front end 50F and the front end 60F is not limited to the present embodiment.

Figure 9:
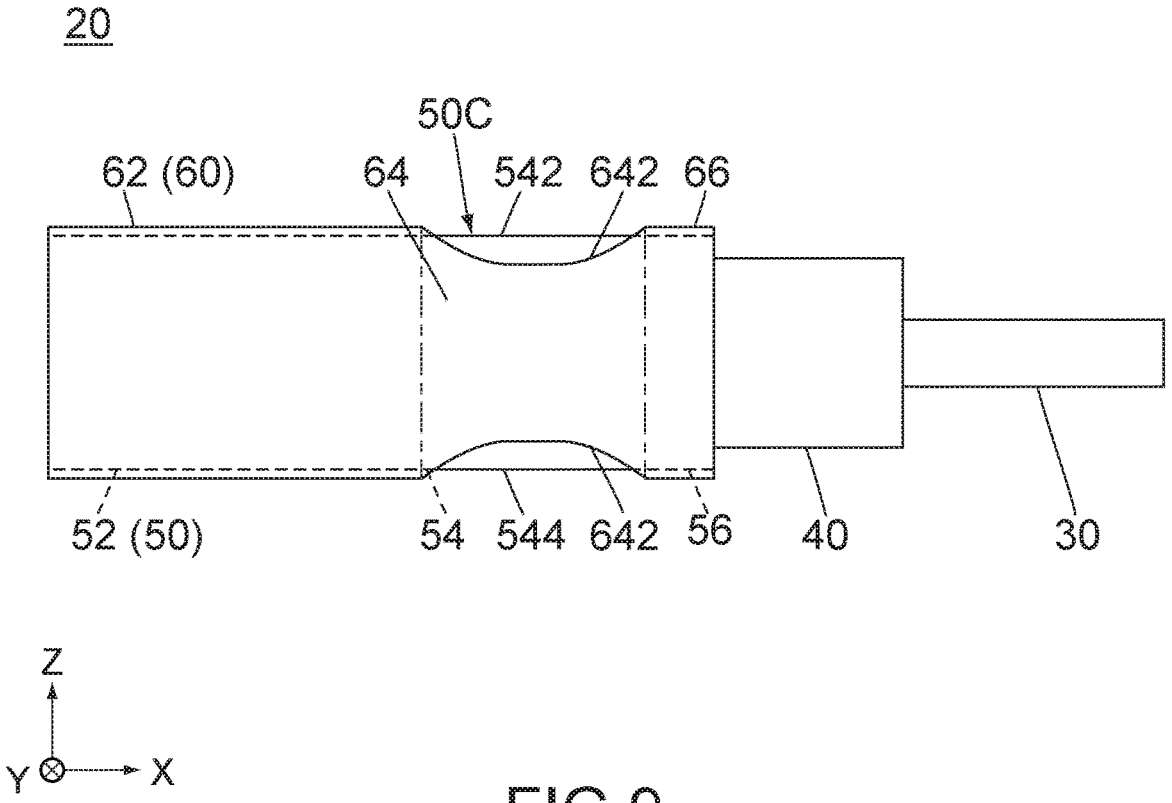
FIG. 9 is a side view showing the coaxial cable of FIG. 8, wherein a hidden outline of an outer conductor is illustrated in dashed line, and a boundary between an annular cover and a partial cover of a second insulator and another boundary between the partial cover and an additional annular cover of the second insulator are illustrated in chain dotted line.

Referring to FIGS. 8 and 9, the outer conductor 50 of the present embodiment has a non-exposed portion 52, a partially-exposed portion 54 and an additional non-exposed portion 56. The partially-exposed portion 54 is located forward of the non-exposed portion 52 in the X-direction, and the additional non-exposed portion 56 is located forward of the partially-exposed portion 54 in the X-direction. The partially-exposed portion 54 extends forward from a front end of the non-exposed portion 52, and the additional non-exposed portion 56 extends forward from a front end of the partially-exposed portion 54.

The second insulator 60 of the present embodiment has an annular cover 62, a partial cover 64 and an additional annular cover 66. The partial cover 64 is located forward of the annular cover 62 in the X-direction, and the additional annular cover 66 is located forward of the partial cover 64 in the X-direction. The partial cover 64 extends forward from a front end of the annular cover 62, and the additional annular cover 66 extends forward from a front end of the partial cover 64.

The annular cover 62 of the second insulator 60 entirely covers the circumference 50C of the non-exposed portion 52 of the outer conductor 50 in the YZ-plane. The additional annular cover 66 entirely covers the circumference 50C of the additional non-exposed portion 56 in the YZ-plane. In contrast, the partial cover 64 covers a part of the circumference 50C of the partially-exposed portion 54 in the YZ-plane. In detail, the partially-exposed portion 54 has a cross-section that is perpendicular to the X-direction, and this cross-section is not entirely but partially exposed from the partial cover 64 regardless of the position thereof in the X-direction.

Figure 10:
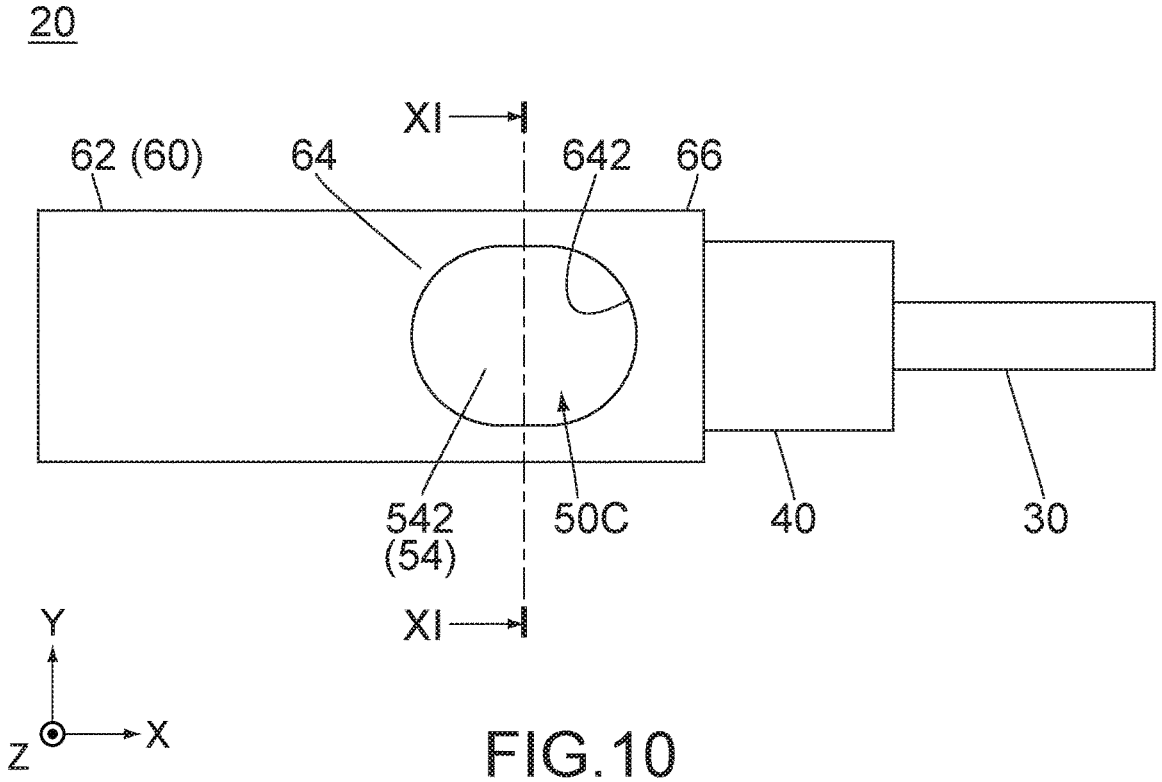
FIG. 10 is a top view showing the coaxial cable of FIG. 8.

More specifically, referring to FIGS. 8 to 10, the partial cover 64 of the present embodiment is formed with two long holes 642 each of which is long in the X-direction. In detail, for each of the long holes 642, a length thereof in the X-direction is longer than another length thereof in the Y-direction. One of the long holes 642 is located at an upper part, or the positive Z-side part, of the partial cover 64, and a remaining one of the long holes 642 is located at a lower part, or the negative Z-side part, of the partial cover 64. Each of the long holes 642 passes through the partial cover 64 in a thickness direction that is a radial direction perpendicular to the X-direction. The partially-exposed portion 54 is exposed outward without being covered by the partially-exposed portion 54 in each of the long holes 642.

Figure 4:
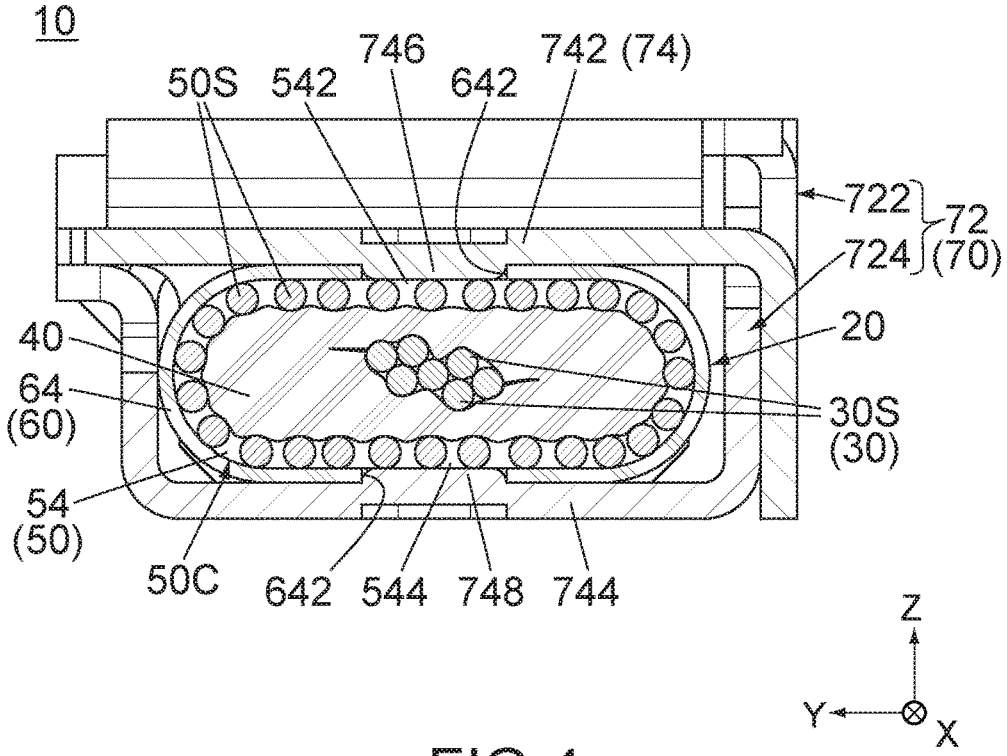
FIG. 4 is a cross-sectional view showing a part of the cable harness of FIG. 3, taken along line IV-IV.

Referring to FIG. 4, two parts of the partially-exposed portion 54 are exposed outward of the second insulator 60 through the long holes 642 and work as connection portions 542 and 544 which are to be connected to the pressure-holding portion 74 of the second conductor 72 of the connector 70. In other words, the partially-exposed portion 54 is formed with the two connection portions 542 and 544 which correspond to the two long holes 642, respectively. Each of the connection portions 542 and 544 is exposed from the partial cover 64 through a corresponding one of the long holes 642.

According to the present embodiment, the connection portions 542 and 544 include an upper connection portion 542 and a lower connection portion 544. The upper connection portion 542 is located on an upper part of the partially-exposed portion 54, and the lower connection portion 544 is located on a lower part of the partially-exposed portion 54. According to the present embodiment, in the YZ-plane, the partial cover 64 covers the partially-exposed portion 54 while only the upper connection portion 542 and the lower connection portion 544 are exposed.

According to the present embodiment, the two long holes 642 have shapes same as each other, so that the two connection portions 542 and 544 have shapes same as each other. Moreover, the two connection portions 542 and 544 are located at positions same as each other in the X-direction and are located at opposite sides of the partially-exposed portion 54 in the Z-direction, respectively. However, the structure of the partially-exposed portion 54 including the connection portions 542 and 544 is not limited to the present embodiment but can be variously modified.

For example, the two connection portions 542 and 544 may have shapes different from each other and may be located at positions different from each other in the X-direction. The partially-exposed portion 54 may have an additional part exposed outward in addition to the two connection portions 542 and 544. In other words, in the YZ-plane, the partial cover 64 may cover the partially-exposed portion 54 while at least the upper connection portion 542 and the lower connection portion 544 are exposed. Instead, the partially-exposed portion 54 may have only one exposed portion that exposed outward. For example, the partially-exposed portion 54 is formed with only the connection portion 542. Thus, in the YZ-plane, the partial cover 64 may cover the partially-exposed portion 54 while only the connection portion 542 is exposed. Moreover, in the YZ-plane, the partial cover 64 may cover the partially-exposed portion 54 while at least the connection portion 542 is exposed.

Hereafter, explanation will be made about a connection mechanism between the connector 70 and the coaxial cable 20.

Referring to FIG. 2, the center conductor 30 of the coaxial cable 20 is positioned in the YZ-plane by the holding member 80 of the connector 70 and held by the holding member 80. The first conductor 82 of the connector 70 is connected to the thus-positioned center conductor 30. In detail, the contact portion 822 of the first conductor 82 is in contact with a lower part of the center conductor 30 to be electrically connected with the center conductor 30. Referring to FIG. 3, when the connector 70 is mated with the mating connector (not shown), the terminal portion 824 of the first conductor 82 is brought into contact with a mating signal contact (not shown) of the mating connector, so that the center conductor 30 is electrically connected with the mating signal contact.

Referring to FIG. 4 together with FIG. 11, the coaxial cable 20 is vertically sandwiched and pressed by the upper ground member 722 and the lower ground member 724. As a result, a part of the coaxial cable 20 is pressed and deformed so that opposite sides thereof protrude in the Y-direction. The pressure-holding portion 74 presses the partial cover 64 of the second insulator 60 to hold the partial cover 64 and is connected to the connection portions 542 and 544 of the partially-exposed portion 54 in a perpendicular direction (Z-direction) perpendicular to the X-direction. As a result, the pressure-holding portion 74 of the second conductor 72 is electrically connected with the outer conductor 50. Referring to FIG. 3, when the connector 70 is mated with the mating connector (not shown), a part of the second conductor 72 located at the mating portion 70F is brought into contact with a mating ground contact (not shown) of the mating connector, so that the outer conductor 50 (see FIG. 4) is electrically connected with the mating ground contact.

Referring to FIG. 4, as previously described, the outer conductor 50 of the coaxial cable 20 according to the present embodiment is formed of a plurality of the wires 50S and has the partially-exposed portion 54 that is formed with the connection portions 542 and 544 connected to the connector 70. The partially-exposed portion 54 is partially covered by the partial cover 64 of the second insulator 60 while the connection portions 542 and 544 thereof are exposed. According to this structure, the partial cover 64 partially covers the wires 50S of the outer conductor 50, so that the wires 50S are prevented from being unevenly separated from one another.

In detail, the partial cover 64 not only prevents uneven separation of the wires 50S outside the connection portions 542 and 544 but also restricts movements of the wires 50S along the circumference 50C inside the connection portions 542 and 544. As a result, the center wires 30S of the center conductor 30 are substantially uniformly shielded so that transmission characteristics are hard to be degraded. Thus, the present embodiment provides the cable harness 10 having transmission characteristics hard to be degraded even if the outer conductor 50 of the coaxial cable 20 is formed of a spiral shield.

According to the present embodiment, the partial cover 64 of the second insulator 60 is sandwiched and pressed by the upper holding portion 742 and the lower holding portion 744 of the pressure-holding portion 74 on opposite sides thereof in the perpendicular direction (Z-direction). The perpendicular direction of the present embodiment is the upper-lower direction (Z-direction). The pressure-holding portion 74 vertically sandwiches and presses the partial cover 64 to hold the partial cover 64 and is connected to the upper connection portion 542 and the lower connection portion 544 in the Z-direction. In detail, the upper holding portion 742 and the lower holding portion 744 of the pressure-holding portion 74 are connected to the upper connection portion 542 and the lower connection portion 544, respectively. However, the present invention is not limited thereto. For example, the perpendicular direction, along which the pressure-holding portion 74 sandwiches and presses the partial cover 64, may be identical to the lateral direction (Y-direction) that is a projecting direction of the mating portion 70F (see FIG. 3).

The pressure-holding portion 74 of the present embodiment includes two holding portions, namely the upper holding portion 742 and the lower holding portion 744, which are connected to the two connection portions 542 and 544 of the outer conductor 50, respectively. The two holding portions are located to be 180° rotational symmetry about the center conductor 30 of the coaxial cable 20 in the YZ-plane. However, the present invention is not limited thereto. For example, the positional relation between the two holding portions in the YZ-plane is not limited to 180° rotational symmetry. In a case where the outer conductor 50 has only the upper connection portion 542, the pressure-holding portion 74 may include only the upper holding portion 742. Instead, the pressure-holding portion 74 may include three or more of the holding portions that are connected to the outer conductor 50.

The projecting portions 746 and 748 of the present embodiment project inward in the perpendicular direction (Z-direction) and are connected to the connection portions 542 and 544, respectively. In detail, the upper projecting portion 746 of the upper holding portion 742 projects downward while passing through the upper one of the long holes 642 of the partial cover 64 and is connected to the upper connection portion 542. The lower projecting portion 748 of the lower holding portion 744 projects upward while passing through the lower one of the long holes 642 of the partial cover 64 and is connected to the lower connection portion 544.

According to the present embodiment, since the upper projecting portion 746 and the lower projecting portion 748 are provided so as to project inward in the perpendicular direction (Z-direction) as described above, the pressure-holding portion 74 can be reliably connected to the outer conductor 50 even in a case where the second insulator 60 is thick. However, the present invention is not limited thereto. For example, in another case where the second insulator 60 is relatively thin or each of the connection portions 542 and 544 has relatively large exposed area, the upper holding portion 742 and the lower holding portion 744 can be pressed against and directly connected to the upper connection portion 542 and the lower connection portion 544, respectively, even if the upper projecting portion 746 and the lower projecting portion 748 are not provided. Thus, each of the upper projecting portion 746 and the lower projecting portion 748 may be provided as necessary.

Referring to FIGS. 3 to 7, according to the present embodiment, each of the projecting portions 746 and 748 of the second conductor 72 is long in the Y-direction perpendicular to both the X-direction and the Z-direction (perpendicular direction). More specifically, each of the projecting portions 746 and 748 extends over a plurality of the wires 50S (see FIG. 4) of the outer conductor 50 in the Y-direction. In addition, each of the projecting portions 746 and 748 is pressed against the middle of a corresponding one of the connection portions 542 and 544 in the X-direction, or pressed against a part farthest from the edge of the long hole 642 in the X-direction. According to the aforementioned structure, each of the projecting portions 746 and 748 is pressed against a plurality of the wires 50S with a strong contact pressure, so that the second conductor 72 can be more securely connected to the outer conductor 50, and the wires 50S can be more reliably prevented from being unevenly separated from one another. However, the present invention is not limited thereto. For example, each of the projecting portions 746 and 748 may extend long in a direction oblique to both the X-direction and the Y-direction.

Referring to FIG. 8, according to the present embodiment, the additional annular cover 66 is located forward of the partial cover 64 and entirely covers the circumference 50C in the YZ-plane of the additional non-exposed portion 56 which is located forward of the partially-exposed portion 54. Referring to FIG. 4 together with FIG. 8, according to the present embodiment, all of the wires 50S of the additional non-exposed portion 56 are covered by the additional annular cover 66, so that the wires 50S can be more reliably prevented from being unevenly separated from one another. However, the present invention is not limited thereto, but the additional annular cover 66 may be provided as necessary.

Referring to FIG. 8, according to the present embodiment, the front end 50F of the outer conductor 50 in the X-direction is located at a position same as that of the front end 60F of the second insulator 60 in the X-direction. Referring to FIG. 4 together with FIG. 8, according to the present embodiment, front ends of the wires 50S are not exposed outward in the YZ-plane, so that the wires 50S can be more reliably prevented from being unevenly separated from one another. In addition, the whole of the outer conductor 50 except the connection portions 542 and 544 can be prevented from being brought into contact with the second conductor 72. However, the present invention is not limited thereto. For example, the front end 50F of the outer conductor 50 in the X-direction may be located rearward of the front end 60F of the second insulator 60 in the X-direction or may be located forward of the front end 60F of the second insulator 60 in the X-direction to some extent.

Referring to FIG. 8, the outer conductor 50 of the present embodiment has only one of the partially-exposed portion 54 between the non-exposed portion 52 and the additional non-exposed portion 56. However, the present invention is not limited thereto. For example, the outer conductor 50 may have the partially-exposed portion 54, a middle non-exposed portion (not shown) located forward of the partially-exposed portion 54 and an additional partially-exposed portion (not shown) located forward of the middle non-exposed portion between the non-exposed portion 52 and the additional non-exposed portion 56.

The cable harness 10 of the present embodiment can be further variously modified in addition to the already described modifications. For example, comparing FIG. 12 with FIG. 5, a cable harness 10A according to a modification comprises a coaxial cable 20A different from the coaxial cable 20 of the cable harness 10 and the connector 70 same as that of the cable harness 10.

Figure 12:
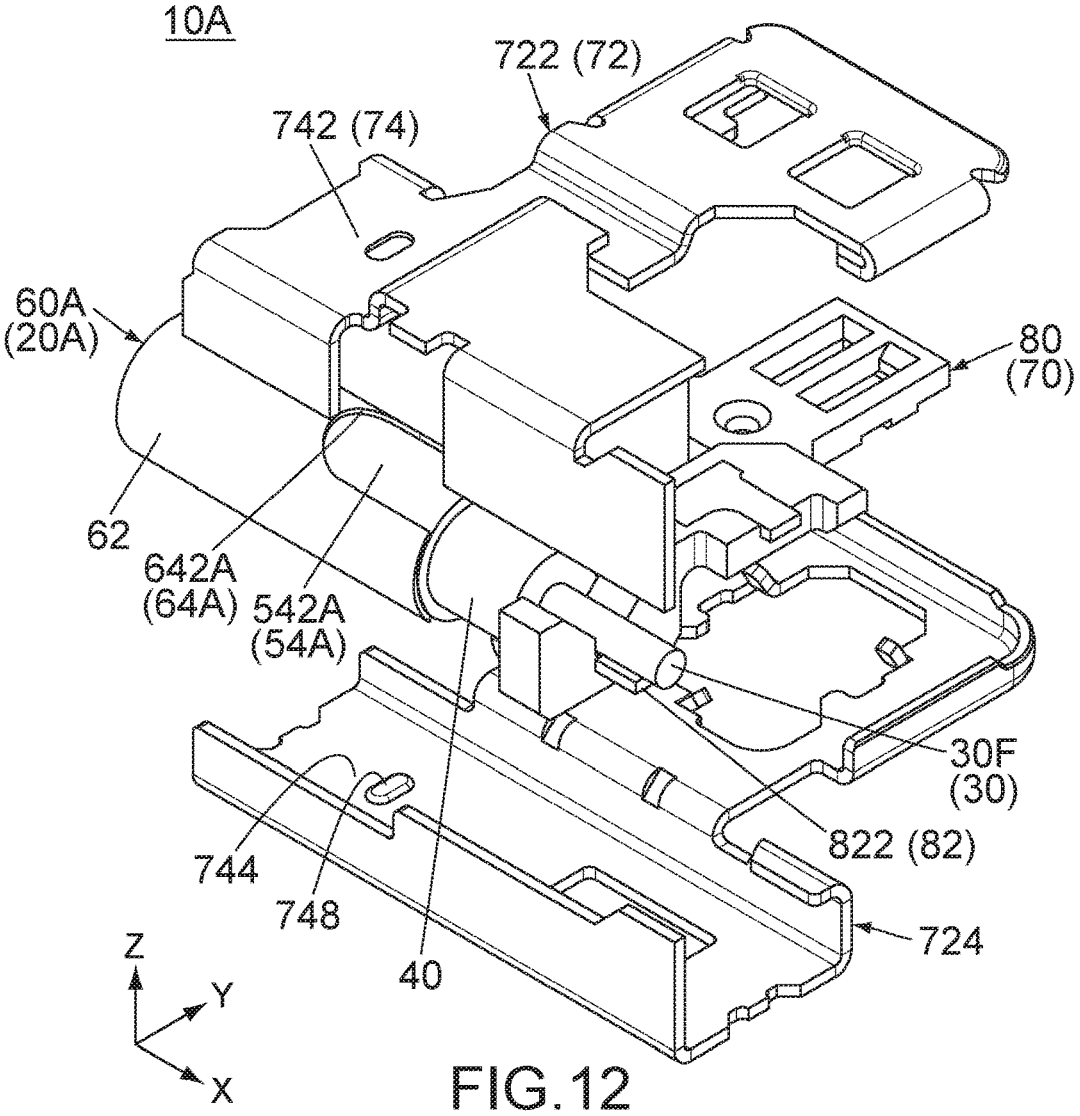
FIG. 12 is an exploded, perspective view showing a modification of the cable harness of FIG. 5.
Figure 13:
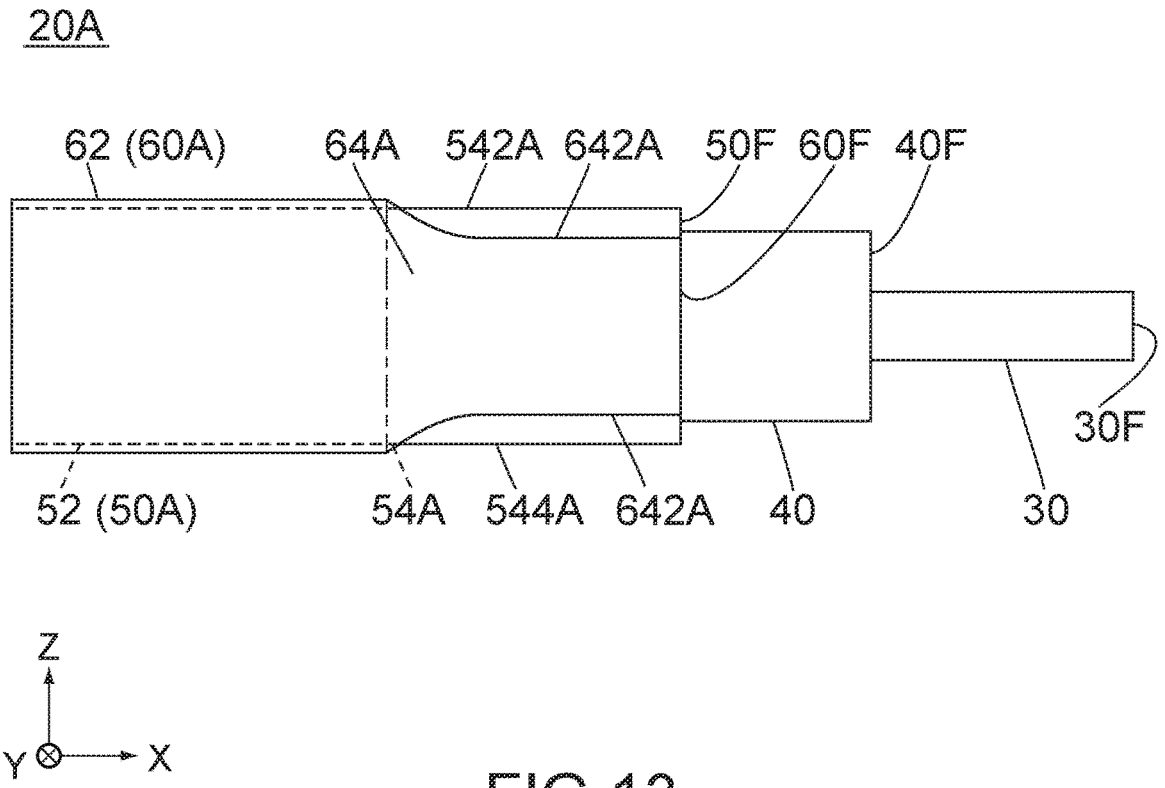
FIG. 13 is a side view showing a coaxial cable of the cable harness of FIG. 12, wherein a hidden outline of an outer conductor is illustrated in dashed line, and a boundary between an annular cover and a partial cover of a second insulator is illustrated in chain dotted line.
Figure 14:
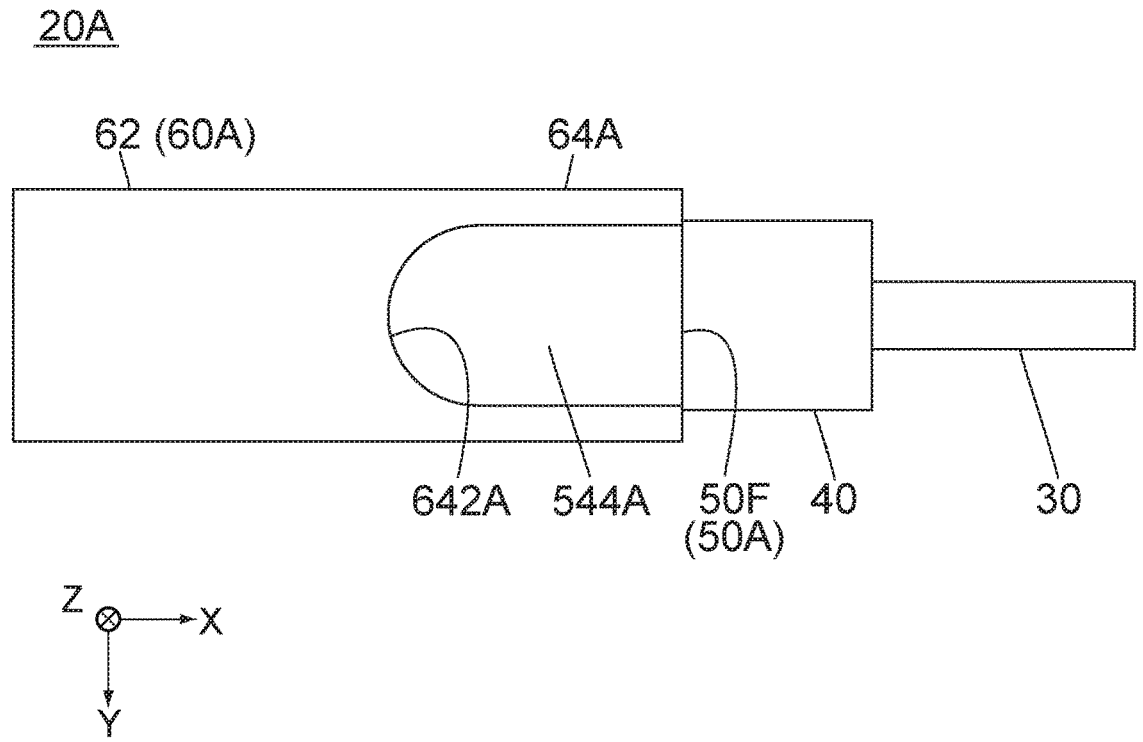
FIG. 14 is a bottom view showing the coaxial cable of FIG. 13.
Figure 15:
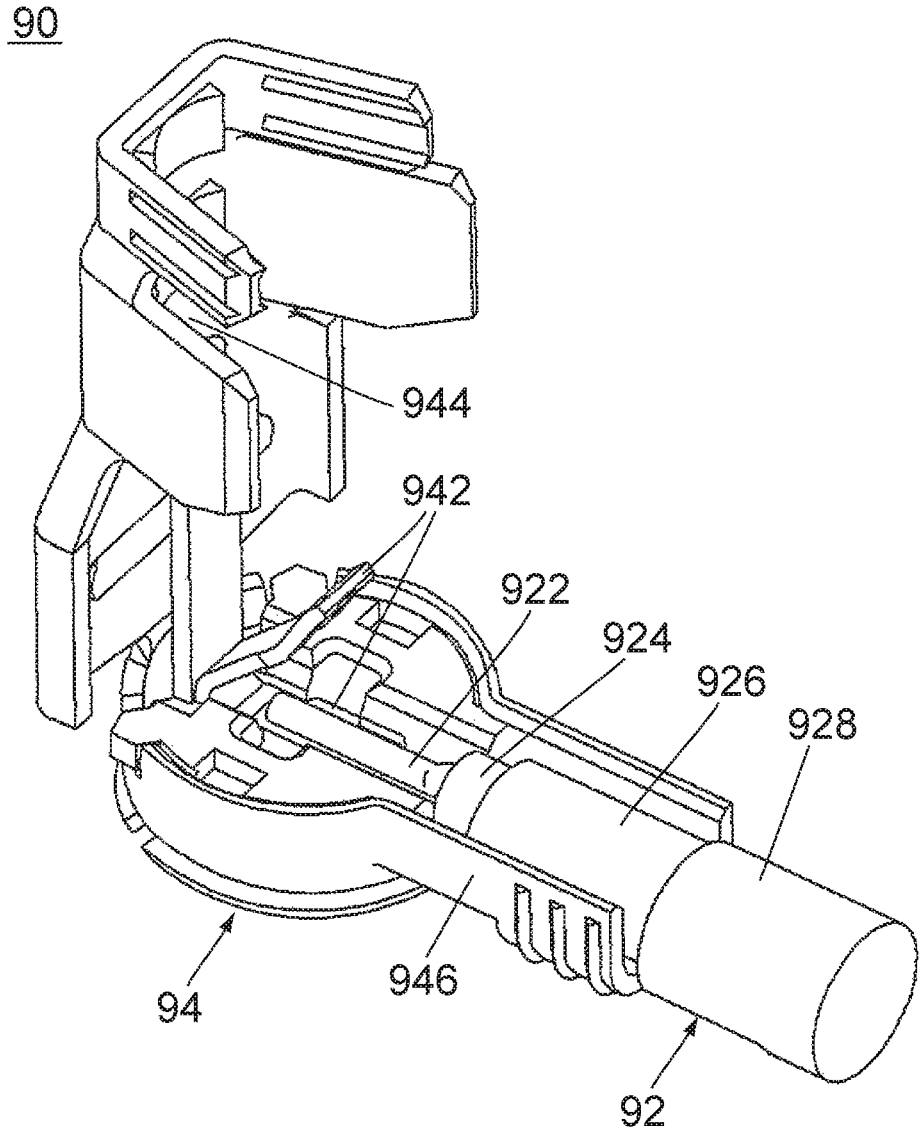
FIG.15 PRIOR ART
FIG. 15 is a perspective view showing a cable harness of Patent Document 1.

Comparing FIGS. 12 to 14 with FIG. 8, the coaxial cable 20A comprises the center conductor 30 and the first insulator 40 same as those of the coaxial cable 20 while comprising an outer conductor 50A and a second insulator 60A which are different from the outer conductor 50 and the second insulator 60 of the coaxial cable 20, respectively. The outer conductor 50A has the non-exposed portion 52 same as that of the outer conductor 50 and a partially-exposed portion 54A different from the partially-exposed portion 54 of the outer conductor 50 but does not have the additional non-exposed portion 56 of the outer conductor 50. The second insulator 60A has the annular cover 62 same as that of the second insulator 60 and a partial cover 64A different from the partial cover 64 of the second insulator 60 but does not have the additional annular cover 66 of the second insulator 60.

Except for the aforementioned differences, the coaxial cable 20A has the structure similar to that of the coaxial cable 20. For example, the partially-exposed portion 54A is formed with two connection portions 542A and 544A. The connection portions 542A and 544A include the upper connection portion 542A and the lower connection portion 544A. The partial cover 64A is formed with, instead of the two long holes 642, two cuts 642A each of which is long in the X-direction. Each of the cuts 642A opens forward. The connection portions 542A and 544A are exposed from the partial cover 64A through the two cuts 642A, respectively. Thus, in the YZ-plane, the partial cover 64A covers the partially-exposed portion 54A while at least the connection portions 542A and 544A are exposed.

Referring to FIG. 12 together with FIG. 4, the cable harness 10A works similarly to the cable harness 10. More specifically, the pressure-holding portion 74 of the cable harness 10A presses the partial cover 64A to hold the partial cover 64A and is connected to the connection portions 542A and 544A in the Z-direction. The partial cover 64A partially cover the wires 50S of the outer conductor 50A, so that the wires 50S are prevented from being unevenly separated from one another. As a result, transmission characteristics are hard to be degraded. Similarly to the previously described embodiment, the present modification provides the cable harness 10A having transmission characteristics hard to be degraded even if the outer conductor 50A of the coaxial cable 20A is formed of a spiral shield.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A cable harness comprising a coaxial cable and a connector, wherein:

the coaxial cable comprises a center conductor, a first insulator covering the center conductor, an outer conductor covering the first insulator and a second insulator covering the outer conductor;

the outer conductor is formed of a plurality of wires and has a non-exposed portion and a partially-exposed portion;

the partially-exposed portion is located forward of the non-exposed portion in a front-rear direction;

the partially-exposed portion is formed with a connection portion;

the second insulator has an annular cover and a partial cover;

the partial cover is located forward of the annular cover;

the annular cover entirely covers circumference of the non-exposed portion in a perpendicular plane perpendicular to the front-rear direction;

in the perpendicular plane, the partial cover covers the partially-exposed portion while at least the connection portion is exposed;

the connector comprises a first conductor, a second conductor and a holding member;

the first conductor and the second conductor are insulated from each other;

the holding member holds the first conductor;

the first conductor is connected to the center conductor;

the second conductor has a pressure-holding portion; and the pressure-holding portion presses the partial cover to hold the partial cover and is connected to the connection portion in a perpendicular direction perpendicular to the front-rear direction.

2. The cable harness as recited in claim 1, wherein:

the outer conductor has an additional non-exposed portion;

the additional non-exposed portion is located forward of the partially-exposed portion;

the second insulator has an additional annular cover; and the additional annular cover is located forward of the partial cover and entirely covers circumference of the additional non-exposed portion in the perpendicular plane.

3. The cable harness as recited in claim 1, wherein:

the partial cover is formed with a long hole;

a length of the long hole in the front-rear direction is longer than another length of the long hole in a direction perpendicular to both the front-rear direction and the perpendicular direction; and the connection portion is exposed from the partial cover through the long hole.

4. The cable harness as recited in claim 1, wherein a front end of the outer conductor in the front-rear direction is located at a position same as or forward of that of another front end of the second insulator in the front-rear direction.

5. The cable harness as recited in claim 1, wherein:

the pressure-holding portion is provided with a projecting portion; and the projecting portion projects inward in the perpendicular direction and is connected to the connection portion.

6. The cable harness as recited in claim 5, wherein a length of the projecting portion in a direction perpendicular to both the front-rear direction and the perpendicular direction is longer than another length of the projecting portion in the front-rear direction.

7. The cable harness as recited in claim 1, wherein:

the perpendicular direction is an upper-lower direction;

the connection portion includes an upper connection portion and a lower connection portion;

the upper connection portion is located at an upper part of the partially-exposed portion;

the lower connection portion is located at a lower part of the partially-exposed portion;

in the perpendicular plane, the partial cover covers the partially-exposed portion while at least the upper connection portion and the lower connection portion are exposed; and the pressure-holding portion vertically sandwiches the partial cover to hold the partial cover and is connected to the upper connection portion and the lower connection portion in the upper-lower direction.

8. The cable harness as recited in claim 7, wherein:

the pressure-holding portion is provided with an upper projecting portion and a lower projecting portion;

the upper projecting portion projects downward and is connected to the upper connection portion; and the lower projecting portion projects upward and is connected to the lower connection portion.

9. The cable harness as recited in claim 8, wherein:

each of the upper projecting portion and the lower projecting portion has a first length in the front-rear direction and a second length in a direction perpendicular to both the front-rear direction and the upper-lower direction; and in each of the upper projecting portion and the lower projecting portion, the second length is longer than the first length.

10. The cable harness as recited in claim 7, wherein:

the second conductor comprises an upper ground member and a lower ground member; and the upper ground member and the lower ground member are vertically combined and cover, at least in part, the first conductor and the holding member in the upper-lower direction.

* * * * *